US005332207A

United States Patent [19]

Oonishi et al.

[11] Patent Number: 5,332,207

[45] Date of Patent: Jul. 26, 1994

[54] PAPER FEEDER AND AN IMAGE FORMING APPARATUS PROVIDED WITH THE SAME

[75] Inventors: Kunihio Oonishi, Osaka; Eiji Gotou, Higashiosaka, both of Japan

[73] Assignee: Mita Industrial Co., Ltd., Osaka, Japan

[21] Appl. No.: 987,108

[22] Filed: Dec. 7, 1992

Related U.S. Application Data

[63] Continuation of Ser. No. 792,551, Nov. 15, 1991, abandoned.

[30] Foreign Application Priority Data

Nov. 30, 1990 [JP] Japan ..... 2-339110
Nov. 30, 1990 [JP] Japan ..... 2-339112

[51] Int. Cl.[5] ..... B65H 7/08

[52] U.S. Cl. ..... 271/110; 271/258; 271/265

[56] References Cited

U.S. PATENT DOCUMENTS

| | | | |
|---|---|---|---|
| 4,132,401 | 1/1979 | Gauronski et al. . | |
| 4,400,085 | 8/1983 | Nezu | 271/261 |
| 4,548,401 | 10/1985 | Nishikawa | 271/265 |
| 4,712,908 | 12/1987 | Nakayama et al. . | |
| 4,740,810 | 4/1988 | Ito . | |
| 4,772,917 | 9/1988 | Tani | 271/3.1 |
| 4,849,788 | 7/1989 | Prebola | 271/3.1 |
| 4,851,885 | 7/1989 | Kurosaki . | |
| 4,954,849 | 9/1990 | Koike et al. | 271/3.1 |
| 5,033,728 | 7/1991 | Miura et al. | 271/3.1 |
| 5,072,923 | 12/1991 | Coy | 271/265 |
| 5,086,319 | 2/1992 | Carolan | 271/265 |
| 5,192,071 | 3/1993 | Kodama | 271/265 |

FOREIGN PATENT DOCUMENTS

| | | | |
|---|---|---|---|
| 0429303 | 5/1991 | European Pat. Off. . | |
| 3622403 | 5/1991 | Fed. Rep. of Germany . | |
| 11571 | 1/1977 | Japan | 271/265 |
| 48318 | 5/1981 | Japan | 271/265 |
| 235337 | 10/1986 | Japan | 271/261 |
| 60-842 | 3/1988 | Japan | 271/265 |
| 310235 | 12/1990 | Japan | 271/265 |
| 2214321 | 8/1989 | United Kingdom . | |

OTHER PUBLICATIONS

Ho, R. Y., "Document Registration Sensor Device", *I.B.M. Technical Disclosure Bulletin*. vol. 22, No. 4, pp. 1366–1367. (Sep. 1979).

*Primary Examiner*—David H. Bollinger
*Attorney, Agent, or Firm*—Jordan and Hamburg

[57] ABSTRACT

A paper feeder is removably attached to an image forming apparatus having a document setter in which a document to be copied is set. The feeder feeds copy paper to the image forming apparatus. A document detector is mounted on one lateral side of the document setter of the image forming apparatus in a position facing a corresponding lateral side end of the document. The document detector detects whether the document is set properly in the document setter. A determining arrangement determines the presence or absence of the document in the document setter on the basis of the detection result of the document detector. A warning arrangement notifies an operator of an error in setting of the document, in the absence of a determination of the presence of the document.

7 Claims, 5 Drawing Sheets

PAPER FEEDER AND AN IMAGE FORMING APPARATUS PROVIDED WITH THE SAME

This application is a continuation of application Ser. No. 07/792,551, filed Nov. 15, 1991, now abandoned.

BACKGROUND OF THE INVENTION AND RELATED ART STATEMENT

This invention relates to a paper feeder provided independently from an image forming apparatus for feeding copy paper to the image forming apparatus, and also an image forming apparatus provided with the same.

There have been conventionally known a paper feeder for feeding copy paper to an image forming apparatus as an optional device of a copying machine, a printer, or the like image forming apparatus.

This paper feeder has two types of cutting modes in which a roll of copy paper (roll paper) is cut to be fed to the image forming apparatus: a normal cutting mode and a synchronous cutting mode. In the normal cutting mode, the roll paper is cut to a size set in an operation unit. On the other hand, in the synchronous mode, when a trailing end of a document to be fed to an exposure unit is detected by a document sensor provided in a rear portion of a document setting portion of the image forming apparatus, whereby the sensor detects a size of the document, the roll paper is automatically cut in correspondence with the document size. More specifically in the case where the synchronous cutting mode is selected, a leading end of the roll paper is transported from the paper feeder to a specified position in the image forming apparatus. After the feed of the document and that of the roll paper are started in synchronism with each other, the roll paper is automatically cut upon the document sensor detecting the trailing end of the document.

In order to prevent an image of a document from being copied obliquely, some of image forming apparatuses of the above type are provided with correcting mechanism for automatically setting the document in position in the case where the document is set obliquely with respect to a feeding direction thereof. However, this mechanism has resulted in a complicated construction and a higher cost.

On the contrary, in an image forming apparatus provided with no such correcting mechanism, when a document is set obliquely in a document setting portion, an image of the document is copied onto copy paper obliquely, necessitating another copying operation for the same document.

Further, in the case where the document is set in the document setting portion without passing through the document sensor, the trailing end of the document cannot be detected. Accordingly, the roll paper is cut to a specified size irrespectively of the document size.

In the case where a jam occurs due to the obliquely fed document or copy paper, in the existing image forming apparatus, jam detection is resumed by turning on a reset key after the jammed document or copy paper is removed. Thus, the image forming apparatus is enabled to detect abnormality such as a jam. However, this construction requires a reset key and an operation for turning on the reset key, whereby necessitating a cumbersome operation.

SUMMARY OF THE INVENTION

In view of the above drawbacks, it is an object of the present invention to provide a paper feeder capable of notifying an operator an occurrence of an error in the case where a document is set obliquely or without passing through a document sensor and automatically clearing an error state thereof only by setting the document properly, and also an image forming apparatus provided with such a paper feeder.

Accordingly, the present invention is directed to a paper feeder removably attachable to an image forming apparatus having a document setting means on which a document to be copied is set and comprising feed means for feeding copy paper to the image forming apparatus, document detector means mountable to one lateral side of the document setting means of the image forming apparatus in such a position as to face corresponding lateral side end of the document and adapted for detecting whether the document is set properly in the document setting means, determination means for determining presence or absence of the document in the document setting means on the basis of detection result of the document detector means, and warning means for notifying an operator of an error in setting the document upon the absence of the document being determined.

With the paper feeder thus constructed, when the presence of the document is determined by the determination means on the basis of the detection result of the document detector means before the start of an image forming operation, the feed of the copy paper to the image forming apparatus is enabled. On the other hand, when the absence of the document is determined before the start of the image forming operation, an occurrence of an error in setting the document is notified to an operator by the warning means. Accordingly, it can be prevented that an image of the document is copied on the copy paper obliquely, or on the copy paper having a size in disagreement with the size of the document. This prevents the copy paper from being wasted, or eliminates the need for re-executing the copying operation for the same document.

Further, the document detector means may be mounted to an upstream portion of the document setting means of the image forming apparatus with respect to a document feeding direction.

With the paper feeder thus constructed, the obliquely set document can be readily detected. Accordingly, it can be more reliably prevented that the image of the document is copied obliquely on the copy paper.

Furthermore, the paper feeder may further comprise feed prohibition means for prohibiting the feed of the copy paper upon the absence of the document being determined by the determination means, and reset means for enabling the feed of the copy paper upon the presence of the document being determined by the determination means after the error is notified.

With the paper feeder thus constructed, the feed of the copy paper is enabled upon the presence of the document being determined by the determination means before the start of the image forming operation. On the other hand, the feed of the copy paper is prohibited upon the absence of the document being determined by the determination means before the start of the image forming operation, whereupon an occurrence of an error in setting the document is notified to an operator by the warning means. Thereafter, when the document is properly set, whereby the presence thereof is detected, prohibition of the feed of the copy paper and the error warning are automatically cleared. Accordingly, it can be prevented that an image of the document is copied on the copy paper obliquely, or on the copy paper having a size in disagreement with the size of the document. In addition, there is no need for providing a key for resetting a state of the paper feeder, and accordingly the reset key manipulating operation. This renders the feeder simplified in construction and improve operability thereof.

Also, according to the present invention, an image forming apparatus may include a paper feeder having the above-mentioned construction. In this case, the image forming apparatus demonstrates the same effects as mentioned above.

The above and other objects, features and advantages of the present invention will become more apparent upon a reading of the following detailed description and drawings.

DETAILED DESCRIPTION OF PREFERRED EMBODIMENTS OF THE INVENTION

Figure 2:
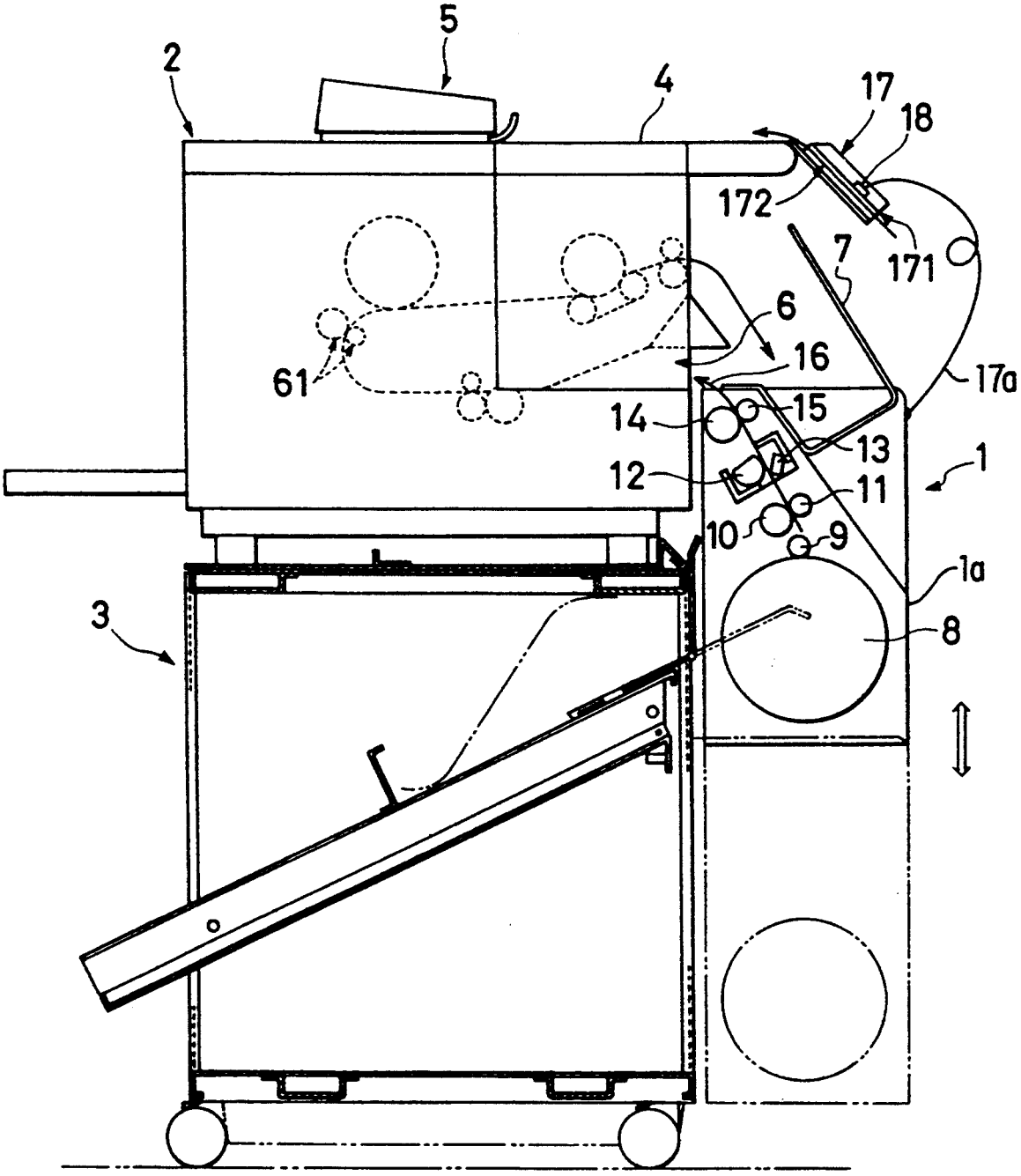
FIG. 2 is a schematic diagram showing a side elevation of the paper feeder attached to an image forming apparatus.

FIG. 2 is a schematic diagram showing a side elevation of a paper feeder 1 attached to a copying machine (image forming apparatus) 2.

The copying machine 2 is supported on a copy paper stocking frame 3. In the copying machine 2, a document set on a document setting portion 4 is fed to an exposure unit 5 in which an image thereof is scanned, and the scanned image is copied onto copy paper inserted through a copy paper inlet 6. A pair of register rollers 61 are adapted for feeding roll paper 8 in such a manner that feeding of the document is conducted in synchronism with that of the roll paper 8 which is disposed in a paper feeder housing 1*a*. More specifically, a leading end of the roll paper 8 is detected by an unillustrated leading end sensor. The pair of register rollers 61, responsive to the leading end sensor, feed the roll paper 8 in such a registered manner as to match the leading end of the roll paper 8 up with that of the document whose image is to be scanned in the exposure unit 5. After the document image is scanned in the exposure unit 5, the document is transported to the left in the place of FIG. 2. The copy paper having the document image copied thereon is discharged onto a discharge tray 7 opening obliquely upward disposed at an upper portion of the paper feeder.

The paper feeder 1 is attached to a front side wall (right side wall in FIG. 2) of the stocking frame 3 and is movable upward and downward. The roll paper (copy paper) 8 is mounted on a roll shaft. Arranged above the roll paper 8 along a direction upward therefrom are a holding roller 9, a pair of feed rollers 10, 11, a pair of cutters 12, 13, and a pair of discharge rollers 14, 15. A delivery opening 16 for the roll paper 8 is provided above the discharge rollers 14, 15. A leading end of the roll paper 8 is fed by the feed rollers 10, 11 to the cutters 12, 13.

The cutter 12 is in the form of a cylinder partly cut away along a plane, and drivingly rotated by an unillustrated drive means. The cutter 13 is disposed as opposed to the cutter 12 with a paid-off portion of the roll paper 8 interposed therebetween. During the rotation of the cutter 12, an edge at the intersection of the plane with a cylindrical surface providing the outer periphery of the cutter 12 comes into frictional contact with an edge of the other cutter 13, whereby the roll paper 8 is cut.

The discharge rollers 14, 15 are in pressing contact with each other, and adapted for transporting the roll paper 8 to the copy paper inlet 6.

The paper feeder 1 includes a document detecting unit 17 mountable on at one lateral side of an upstream portion of the document setting portion 4 with respect to the document feeding direction in such a position as to face corresponding one lateral side face of the document set in the document setting portion 4. FIG. 2 shows an electrical connection 17*a* between the document detecting unit 17 and the paper feeder housing 1*a*. The document detecting unit 17 includes a document sensor 18 for detecting presence or absence of the document. More specifically, the document detecting unit 17 has a document inlet 171 provided at a rear end thereof with respect to the document feeding direction. The document inlet 171 is configured in a U-shape opening in a widthwise direction of the document setting portion 4, i.e., in a direction vertical to the plane of FIG. 2, and the U-shaped portion thereof defines a document path 172 through which the document is inserted. The document sensor 18 is provided above the document path 172. The sensor 18 includes a photosensor or the like and is adapted for detecting the presence or absence of the document in the document path, and sends a corresponding sensor signal to a control unit 23 to be described below. The sensor 18 detects the document only in the case where the document is properly set in the document setting portion 4 through the document path 172.

Figure 1:
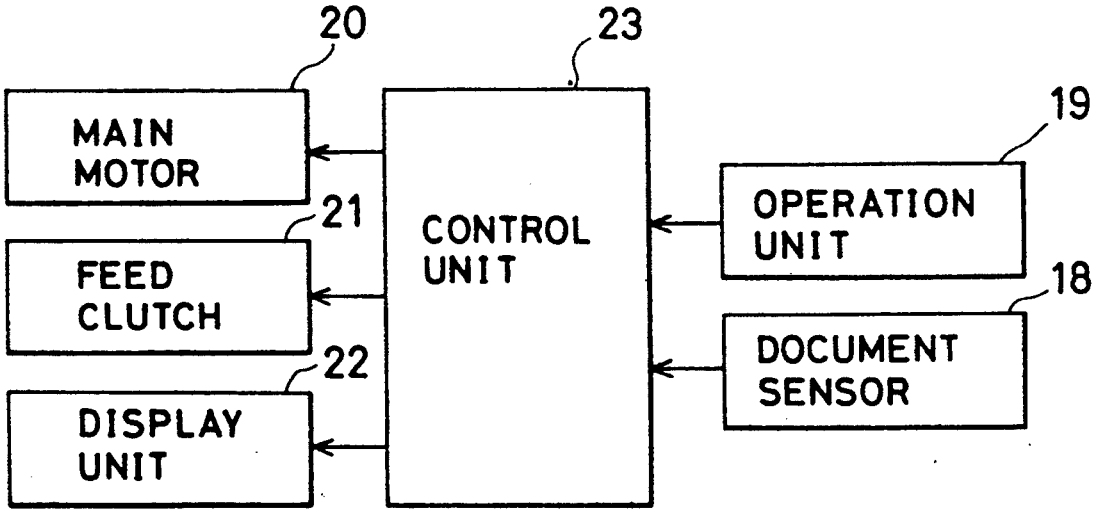
FIG. 1 is a block diagram showing a control system of a paper feeder embodying the present invention.

Next, there will be described a control system of the paper feeder 1 with reference to a block diagram shown in FIG. 1.

Figure 3:
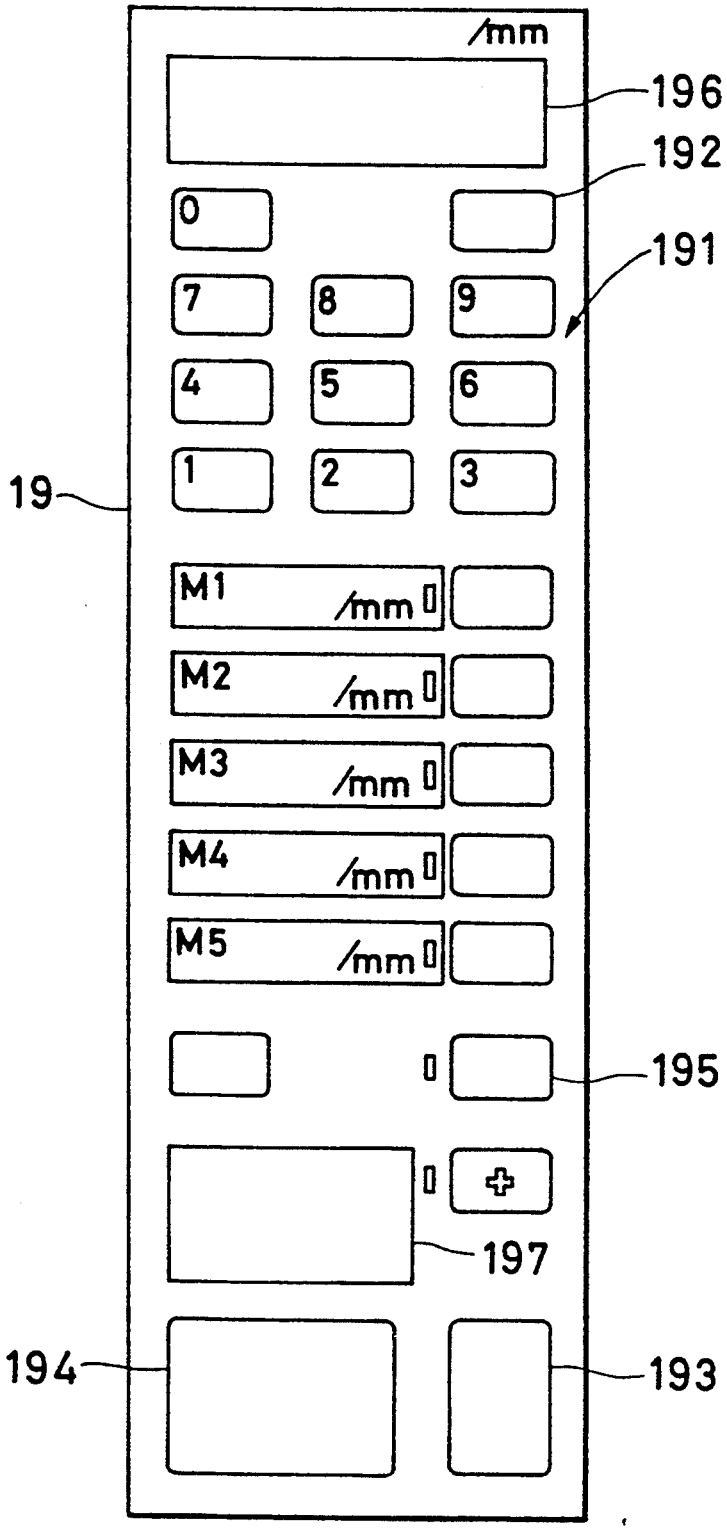
FIG. 3 is a plan view of an operation unit of the paper feeder.

As shown in FIG. 3, an operation unit 19 comprises ten number entry keys (ten keys) 191, a clear key 192, a start key 193, a stop key 194, a synchronous cutting mode selection key 195, indicators 196, 197, and the like. The ten keys 191 are manipulated to set a size to which the roll paper 8 is to be cut, and a number of necessary cut sheets. The clear key 192 is manipulated for clearing an error indication or other indication. The synchronous cutting mode selection key 195 is manipulated to change a cutting mode to the synchronous cutting mode. The indicator 196 is adapted for displaying the set cut size of the roll paper 8, and the indicator 197 is adapted for displaying the set number of cut sheets. Contents set by the keys in the operation unit 19 are output to the control unit 23. A main motor 20 is drivingly rotated in accordance with a control signal sent from the control unit 23. A feed clutch 21 is engaged upon receipt of a control signal from the control unit 23. The feed clutch 21 is adapted for transmitting the rotational force of the main motor 20 to the pairs of feed rollers 10, 11 and discharge rollers 14, 15 upon engagement.

A display unit 22 is provided in a specified position of the paper feeder 1 for displaying an error indication in accordance with an error signal sent from the control unit 23.

In accordance with the contents set in the operation unit 19 and the sensor signal from the document sensor 18, the control unit 23 on-off controls the main motor 20 and the feed clutch 21, and sends the error signal to the display unit 22.

Thus is will be seen from the above that the paper feeder 1, including all of its parts, that is, including such parts as the detecting unit 17, the control unit 23, the operation unit 19, and the display unit 22, is provided independently of the image forming apparatus 2 and is removably attached to the image forming apparatus 2.

Figure 4:
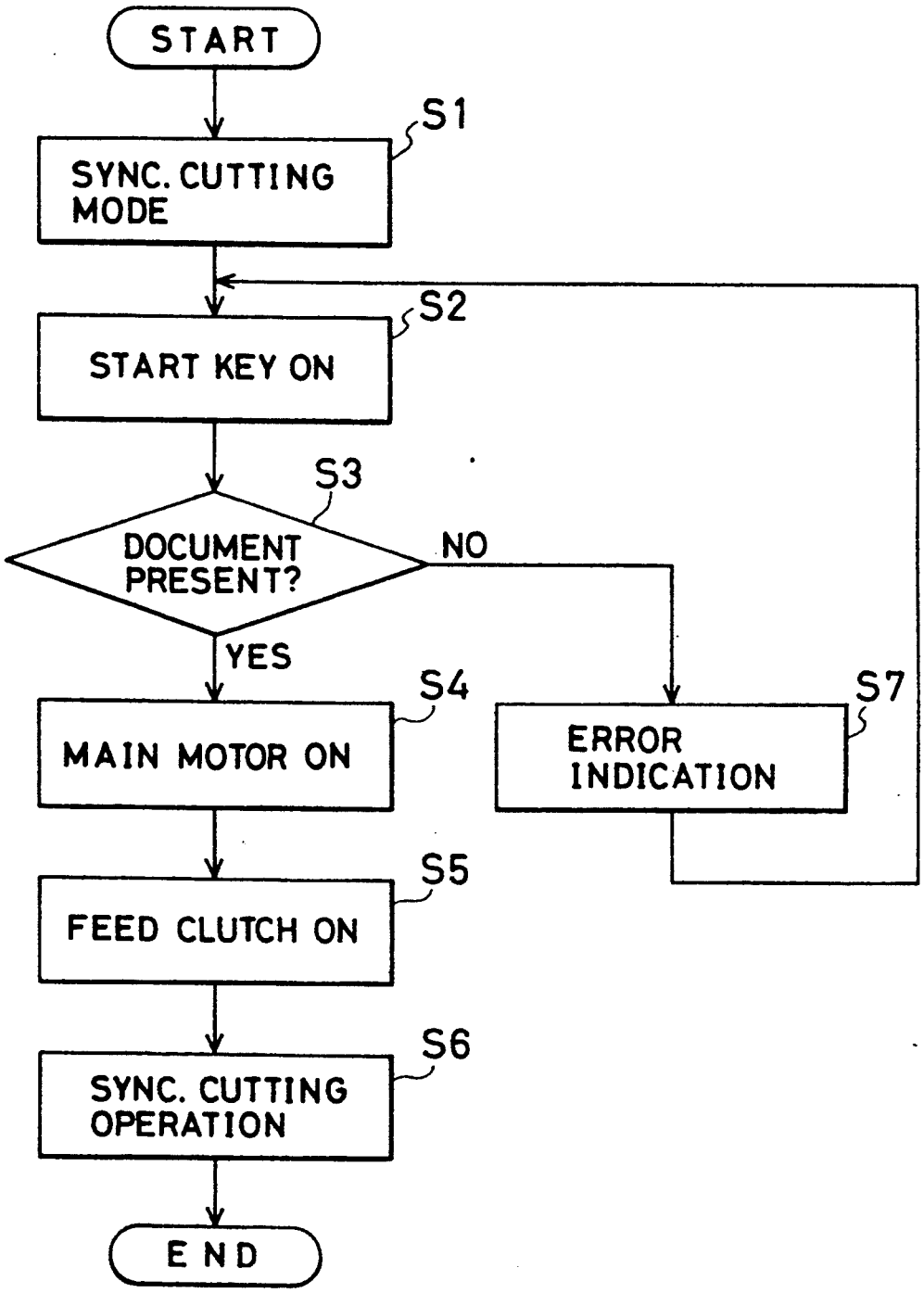
FIG. 4 is a flow chart showing operations of the paper feeder.

Next, there will be described an operation routine of the paper feeder 1 with reference to a flow chart shown in FIG. 4. It will be understood that the main motor 20 and the feed clutch 21 are both set in the respective off-states before the start of the operation.

The routine is initiated by depressing the selection key 195 so as to change a cutting mode to the synchronous cutting mode in Step S1. When the start key 193 is depressed on in Step S2, the document sensor 18 detects the presence or absence of the document in Step S3. In the case where the document sensor 18 detects the presence of the document (YES in Step S3), i.e., the document is properly set in the document setting portion 4 through the document detecting unit 17, the main motor 20 is caused to drivingly rotate in Step S4 and the feed clutch 21 is engaged in Step S5. Subsequently, the roll paper 8 is fed by the pairs of feed rollers 10, 11 and discharge rollers 14, 15 through the copy paper inlet 6 to the pair of register rollers 61. Upon the leading end of the roll paper 8 reaching the register rollers 61, the feed of the document and that of the roll paper 8 are started in synchronism with each other, whereby an image of the document is copied onto the roll paper 8.

Thereafter, in Step S6, the document sensor 18 detects the trailing end of the document when the document passing through the document detecting unit 17. As synchronously timed with the trailing end detection of the document sensor 18, the cutter 12 is drivingly rotated to cut the roll paper 8, so that the size of the cut sheet of the roll paper 8 corresponds with that of the document. In this way, a synchronous cutting operation is executed, and whereby this routine is completed.

On the other hand, in the case where the sensor detects the absence of the document (NO in Step S3), this means that the document is set obliquely relative to the document detecting unit 17, or without passing through the document detecting unit 17. If scanning of the document is started in this state, the document image is copied obliquely on the cut sheet of the roll paper 8, or the roll paper 8 is cut to a predetermined size irrespective of the document size, thereby resulting in an erroneous copying operation. Therefore, an error indication is displayed in the display unit 22 in Step 7, whereby notifying an operator of the likelihood that the erroneous copying operation occurs.

The above predetermined size irrespective of the document size is a size, for example, having a length more than the longest distance between the roller pairs adapted for transporting the roll paper 8 in the copying machine 2 and indicated in broken lines in FIG. 2 so that the cut sheet of the roll paper 8 is not likely to cause a jam in the copying machine 2.

Thereafter, when the document is properly set and the start key 193 is depressed on in Step 2, the roll paper 8 is fed to the output 6.

In this way, it is detected in the paper feeder 1 whether the document is properly set in the document setting portion 4 before the copying operation is started in the copying machine 2. In the case where the document is set in the document setting portion 4 obliquely or without passing through the document detecting unit 17, the error indication is displayed in the display unit 22. As a consequence, an erroneous copying operation can be prevented.

Figure 5:
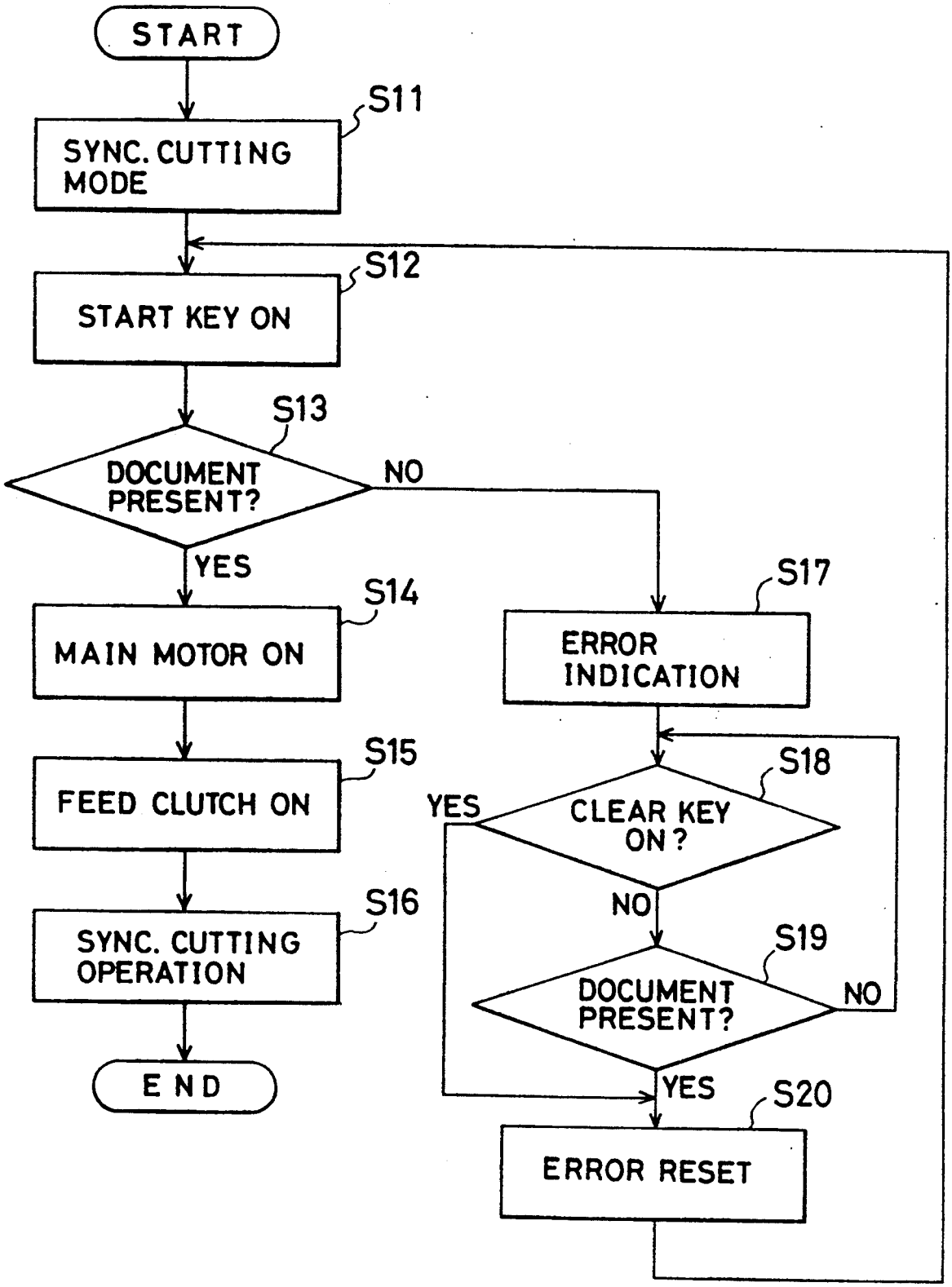
FIG. 5 is another flow chart showing operations of the paper feeder.

Next, there will be described an operation routine of the paper feeder 1 with reference to another flow chart shown in FIG. 5. In this routine, the control unit 23 constantly detects the presence or absence of the document in accordance with the sensor signal sent from the document sensor 18.

The routine is initiated by depressing the selection key 195 so as to change a cutting mode to the synchronous cutting mode in Step S11. When the start key 193 is depressed on in Step S12, the document sensor 18 detects the presence or absence of the document in Step S13. In the case where the document sensor 18 detects the presence of the documents (YES in Step S13), i.e., the document is properly set in the document setting portion 4 through the document detecting unit 17, the main motor 20 is caused to drivingly rotate in Step S14 and the feed clutch 21 is engaged in Step S15. Subsequently, the roll paper 8 is fed by the pairs of feed rollers 10, 11 and discharge rollers 14, 15 through the copy paper inlet 6 to the pair of register rollers 61. Upon the leading end of the roll paper 8 reaching the register rollers 61, the feed of the document and that of the roll paper 8 are started in synchronism with each other, whereby an image of the document is copied onto the roll paper 8.

Thereafter, in Step S16, the document sensor 18 detects the trailing end of the document when the document passing through the document detecting unit 17. As synchronously timed with the trailing end detection of the document sensor 18, the cutter 12 is drivingly rotated to cut the roll paper 8, so that the size of the cut sheet of the roll paper 8 corresponds with that of the document. In this way, a synchronous cutting operation is executed, and whereby this routine is completed.

On the other hand, in the case where the sensor 18 detects the absence of the documents (NO in Step S13), this means that the document is set obliquely relative to the document detecting unit 17, or without passing through the document detecting unit 17. If scanning of the document is started in this state, the document image is copied obliquely on a cut sheet of the roll paper 8, or the roll paper 8 is cut to a predetermined size irrespective of the document size, thereby resulting in an erroneous copying operation. Accordingly, the feed of the roll paper 8 is prohibited and an error indication is displayed on the display unit 22 in Step S17, whereby notifying an operator of the likelihood that the erroneous copying operation occurs.

Thereafter, when the clear key 192 is depressed on (YES in Step S18), the feed of the roll paper 8 is enabled and the error indication on the display unit 22 is cleared in Step S20. When the document is properly set in the document setting portion 4 and the start key 193 is depressed on in Step S12, the roll paper 8 is fed to the copy paper inlet 6.

Alternatively, the presence of the document may be detected (YES in Step S19) upon the document being set properly after the error indication is displayed on the display unit 22 (NO in Step S18), instead of depressing the start key 193 on. Thereby, the feed of the roll paper 8 is enabled and the error indication on the display unit 22 is cleared in Step S20, and the routine returns to Step S12. Subsequently, when the start key 193 is depressed on in Step S12, the roll paper 8 is fed to copy paper inlet 6.

In this way, it is detected in the paper feeder 1 whether the document is properly set in the document setting portion 4 before the copying operation is started in the copying machine 2. In the case where the document is set in the document setting portion 4 obliquely or without passing through the document detecting unit 17, the feed of the roll paper 8 is prohibited and the error indication is displayed in the display unit 22. As a consequence, an erroneous copying operation can be prevented. Further, the feed of the roll paper 8 can be enabled and the error indication can be cleared by depressing the clear key 192. Alternatively, the feed of the roll paper 8 can be enabled and the error indication can be cleared automatically respectively by properly setting the document in the document setting portion 4. Therefore, in the case where the copying operation is to be stopped after the error indication, it is appropriate to depress the clear key 192 on. On the other hand, in the case where a successive copying operation is to be made, it is appropriate to set the document properly, whereupon the roll paper 8 is fed immediately, enabling the copying operation.

In the foregoing embodiment, the error indication is displayed on the display unit 22 so as to notify the operator of the likelihood of an erroneous copying operation. However, a buzzer or other sound alarm device may be provided, instead of the display unit 22, so as to notify the operator of the likelihood of the erroneous copying operation by buzzing sounds. Alternatively, it may be appropriate, for example, to cause the indicators 196, 197 to light on and off upon detecting the likelihood of the erroneous copying operation, instead of provision of the display unit 22.

Further, in the foregoing embodiment, the roll paper 8 is cut to be fed to the copying machine 2. However, the present invention can also be applied to a paper feeder for feeding copy sheet of a specified size. By incorporating the present invention into such a paper feeder, there can be prevented an erroneous copying operation due to the obliquely set document.

Further, in the second operation routine of the paper feeder 1, the roll paper 8 is fed to the copy paper inlet 6 when the start key 193 is depressed on after the error indication is cleared. However, an operation routine may be such that it returns to Step S13 from Step S20 instead of returning to Step 12. In other words, when the document is properly set in the document setting portion 4 after the error indication is cleared, the presence of the document is detected. This is immediately followed by the start of feeding of the roll paper 8 to the copying machine 2.

Although the present invention has been fully described by way of example with reference to the accompanying drawings, it is to be understood that various changes and modifications will be apparent to those skilled in the art. Therefore, unless otherwise such change and modifications depart from the scope of the invention, they should be construed as being included therein.

What is claimed is:

1. A paper feeder for use with an image forming apparatus wherein said paper feeder is provided independently of the image forming apparatus, said paper feeder comprising:

paper transport means for transporting copy paper to a discharge outlet, said paper transport means being positional juxtaposed to said image forming apparatus such that copy paper discharged from said discharge outlet is fed to said image forming apparatus;

document detection means positionable on said image forming apparatus and operable to detect whether a document to be imaged by said image forming apparatus is properly set on said image forming apparatus; and control means connected between said paper transport means and said document detection means, said control means comprising prohibition means for prohibiting transport of copy paper by said paper transport means when said document detection means detects that a document has not been properly set on said image forming apparatus, said control means further comprising warning means for notifying an operator when said document detection means detects that a document has not been properly set on said image forming apparatus;

whereby said paper feeder is provideable independently of said image forming apparatus.

2. A paper feeder as defined in claim 1 wherein said control means comprises:

reset means for enabling the feed of the copy paper by said paper transport means upon the determination of the presence of the document by the document detection means after the notification of an improperly set document by said warning means.

3. A paper feeder as defined in claim 1 wherein the paper transport means includes a support member for rotatably supporting roll paper, a feeding mechanism for unrolling and feeding the roll paper, and a cutter for cutting unrolled paper at a predetermined interval.

4. A paper feeder as defined in claim 3 wherein the cutter is responsive to the document detector means for cutting the roller paper when the document detector means detects a trailing end of the document.

5. The combination comprising an image forming apparatus and a paper feeder apparatus for feeding copy paper to the image forming apparatus and wherein the paper feeder apparatus is provided independently of the image forming apparatus, the combination comprising:

an image forming apparatus having a document setting means for receiving a document to be copied, said image forming apparatus having an inlet to receive copy paper;

paper feeder apparatus comprising a paper discharge outlet and paper transport means for transporting copy paper to said discharge outlet, said paper transport means being positioned juxtaposed to said image forming apparatus such that copy paper discharged from said discharge outlet is fed to said inlet of said image forming apparatus;

said paper feeder apparatus further comprising document detection means positioned on said document setting means of said image forming apparatus and operable to detect whether a document to be imaged by said image forming apparatus is properly set on said document setting means;

said paper feeder apparatus further comprising control means connected between said paper transport means and said document detection means, said control means comprising prohibition means for prohibiting transport of copy paper by said paper transport means when said detecting means detects that a document has not been properly set on said document setting means, said control means further comprising warning means for notifying an operator when said detecting means detects that a document has not been properly set on said document setting means;

whereby said paper feeder apparatus is provideable independently of said image forming apparatus.

6. The combination as defined in claim 5 wherein the document detection means is mounted to an upstream portion of the document setting means with respect to a document feeding direction.

7. The combination as defined in claim 5 wherein said control means comprises:

reset means for enabling the feed of the copy paper by said paper transport means upon the determination of the presence of the document being by the document detection means after notification of an improperly set document by said warning means.

* * * * *

UNITED STATES PATENT AND TRADEMARK OFFICE

CERTIFICATE OF CORRECTION

PATENT NO. : 5,332,207

DATED : July 26, 1994

INVENTOR(S) : Kunihiro Oonishi and Eliji Gotou

It is certified that error appears in the above-indentified patent and that said Letters Patent is hereby corrected as shown below:

On the title page, item [75]:
Change the spelling of the first inventor's name from "Kunihio Oonishi" to --Kunihiro Oonishi--.

Signed and Sealed this

Eighth Day of November, 1994

Bruce Lehman

*Attest:*

BRUCE LEHMAN

*Attesting Officer*

*Commissioner of Patents and Trademarks*